US007011270B1

(12) United States Patent
Chouinard et al.

(10) Patent No.: US 7,011,270 B1
(45) Date of Patent: Mar. 14, 2006

(54) FENCING REWINDER

(76) Inventors: Ronald D. Chouinard, 1228 S. 13th St., Escanaba, MI (US) 49829; Jeffrey J. Lancour, 7822 Tieroary Rd., Gladstone, MI (US) 49837

( * ) Notice: Subject to any disclaimer, the term of this patent is extended or adjusted under 35 U.S.C. 154(b) by 0 days.

(21) Appl. No.: 10/858,562

(22) Filed: Jun. 1, 2004

Related U.S. Application Data

(60) Provisional application No. 60/474,639, filed on May 29, 2003.

(51) Int. Cl.
*B65H 75/24* (2006.01)

(52) U.S. Cl. ..... 242/578.2; 242/403; 242/557

(58) Field of Classification Search ..... 242/578, 242/578.2, 596.7, 403, 533.8, 557, 534, 563, 242/390, 608.5
See application file for complete search history.

(56) References Cited

U.S. PATENT DOCUMENTS 4,930,718 A * 6/1990 Lancour et al. ..... 242/557
5,388,782 A * 2/1995 King ..... 242/557
5,806,779 A * 9/1998 Crum ..... 242/399.1
5,895,197 A * 4/1999 Mc Vaugh ..... 414/680
5,897,073 A * 4/1999 McVaugh ..... 242/399.1
6,229,094 B1 * 5/2001 Krause ..... 174/177
6,543,713 B1 * 4/2003 Frolander et al. ..... 242/399.1
6,786,446 B1 * 9/2004 Kaul et al. ..... 242/557
2004/0227031 A1 * 11/2004 Yoder et al. ..... 242/390.5

* cited by examiner

*Primary Examiner*—Kathy Matecki
*Assistant Examiner*—Sang Kim
(74) *Attorney, Agent, or Firm*—John R. Benefiel

(57) ABSTRACT

A rewinder for fencing fabric hooked to a utility vehicle and including a pair of spaced apart side plates mounted on a framework to be adjustable towards and away from each other by telescoping tubes included in the framework. A core is driven by a motor on one side plate engaging one end of the core, the opposite end supported on the other side plate. A guard extends over the core and roll of fabric rewound thereon, pivoted to swing down and rest on the roll as the fabric is being rewound. The guard is interconnected with a control for the motor which reduces the motor speed as the roll diameter increases, so that the fabric linear speed is kept at a moderate speed even as the roll diameter increases.

6 Claims, 6 Drawing Sheets

FENCING REWINDER

CROSS REFERENCE TO RELATED APPLICATIONS

This application claims the benefit of U.S. provisional Ser. No. 60/474,639, filed May, 2003.

BACKGROUND OF THE INVENTION

This invention concerns fencing and more particularly fencing in which a metal fencing fabric such as chain link is attached to line posts to create a fence.

Such fence construction is widely used in large projects such as airports, prisons, corporate facilities, etc. Such fencing fabric comes in large rolls and the present inventors have been issued U.S. Pat. No. 4,930,718 for apparatus for handling and dispensing fencing fabric from a roll during erection of the fence.

It sometimes becomes necessary to handle unwound fabric, as when large lengths of fabric is removed, replacing fabric or when rewinding unneeded dispensed fabric.

Chain link fabric is heavy and stiff and manual handling of unrolled fabric is slow and difficult.

U.S. Pat. No. 5,388,782 describes a vehicle mounted powered rewinder for snow fencing, in which an electric motor drives a wind up drum at a constant speed. The fence is wound up onto the drum, which is mounted so as to allow the wound up roll to be removed from the drum.

This design is effective for snow fencing which is usually a single height and due to the presence of the wooden slats, is stiff across its width and thus easier to rewind. In the case of chain link or other fencing fabric, it can be of many different heights (widths when lying on the ground) and a rewinder should be able to adapt to all of these sizes.

Fencing fabric is less stiff across its width and is prone to misalignment and kinking when attempted to be rewound.

Especially when the roll becomes large, the linear speed of the fencing still on the ground being pulled onto the roll increases substantially creating increased hazards to the operator or bystanders. The possibility of misalignment of the turns of the rewound fabric also increases with the speed at which winding process.

The powered rewind method itself presents some risks and safety measures alleviating some of these risks is desirable.

The aforementioned U.S. patent describes a complex design in order to allow removal of wound fencing from a wind up drum.

It is an object of the present invention to provide a vehicle mounted powered fencing fabric rewinder configured to conveniently accommodate fencing fabric of varying widths.

It is another object to provide such a rewinder which guides the fabric during rewinding to insure alignment of successive windings.

It is still another object to provide such a rewinder which does not create unduly high rates of linear speed of the fabric material as the roll becomes larger.

It is yet another object to provide a simplified arrangement for releasing the wound up fabric from a core on which it is wound.

It is also an object of the invention to provide a powered rewinder which has safety features protecting the operator and bystanders.

SUMMARY OF THE INVENTION

These and other objects of the present invention which will be understood upon a reading of the following specification and claims are achieved by a powered rewinder in which a rewinder core is mounted between guide side plates held together by telescoping lengths of square tubing, which telescoping allows an adjustment of the spacing between the side plates to accommodate various sizes of fencing fabric.

The side plates have outwardly angled entry portions which assists in guiding the fabric onto the roll to produce good alignment of successive windings of the rewound material.

A variable speed hydraulic motor is used to drive a wind up core, which motor is controlled by a linkage shifted by a hinged cage swung down onto the outside of the roll so that the motor rotates more slowly as the roll becomes larger, avoiding excessive linear speeds of the fabric. The cage also assists in smoothing the fabric as it is wound onto the roll and removing vegetation or debris, as well as preventing kinking and distorting of the fabric as it is wound onto the roll.

A prop rod allows the cage to be held out of the way when the connecting the wind up core and unloading a roll of rewound fencing fabric.

A dual rod simplified removable core is also provided.

A safety shield is provided for deflecting any debris away from the operator's cab.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
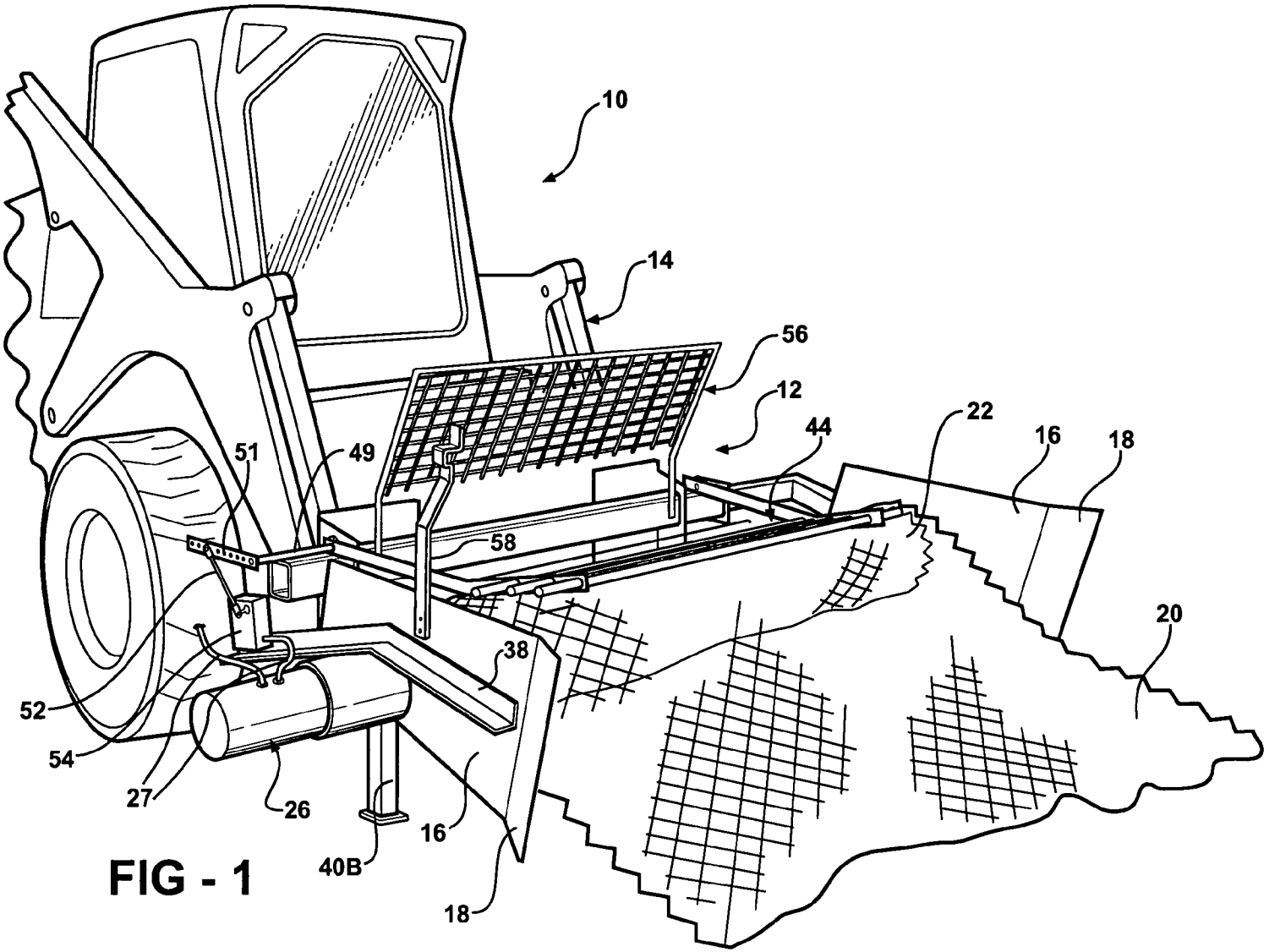
FIG. 1 is a pictorial fragmentary view of a utility vehicle having a fencing fabric rewinder according to the present invention installed thereon, with a length of fencing fabric partially rewound thereon.
Figure 2:
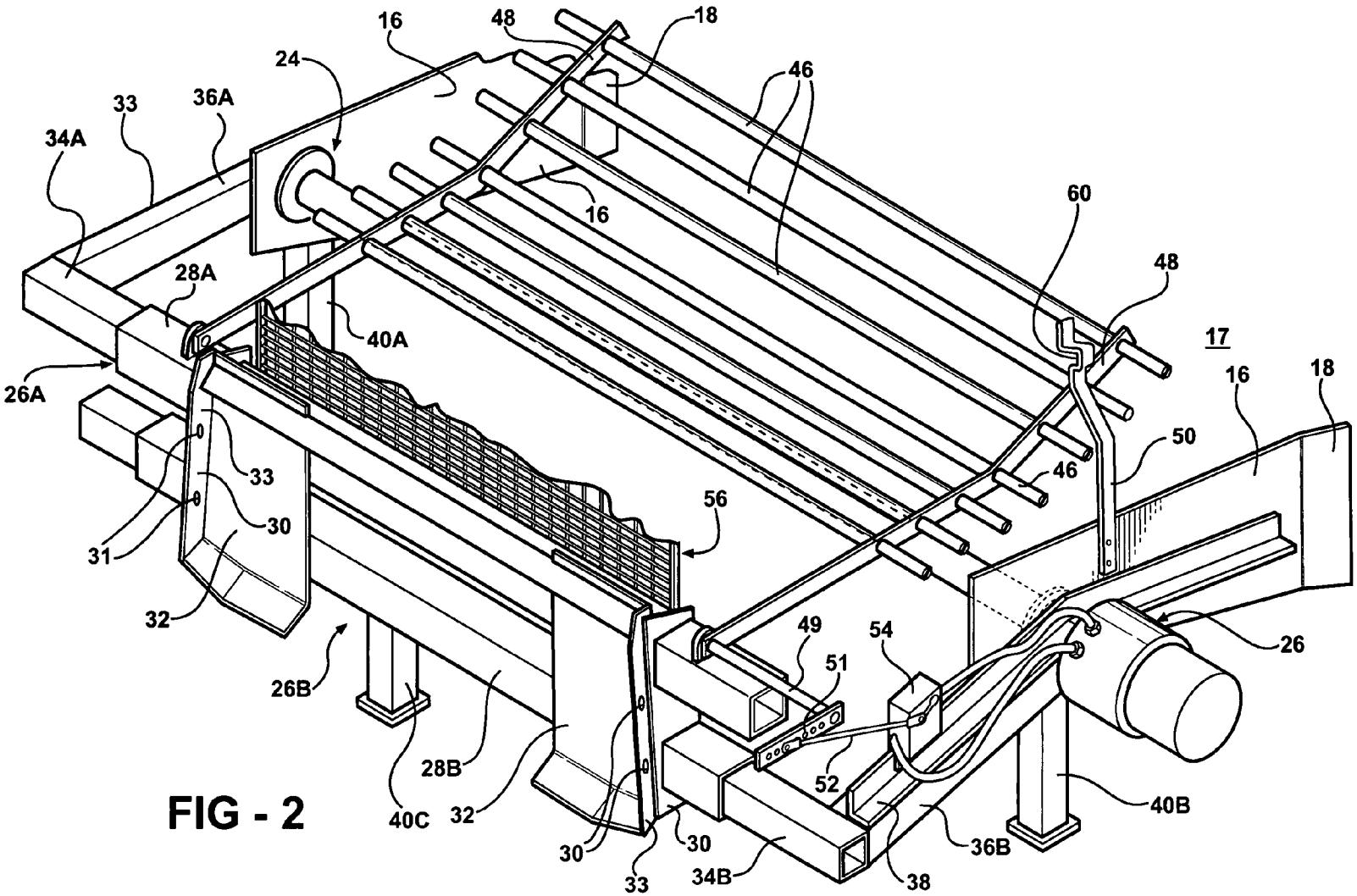
FIG. 2 is a pictorial view of the fencing fabric rewinder shown in FIG. 1, with a portion of one of the side plates partially broken away.
Figure 3:
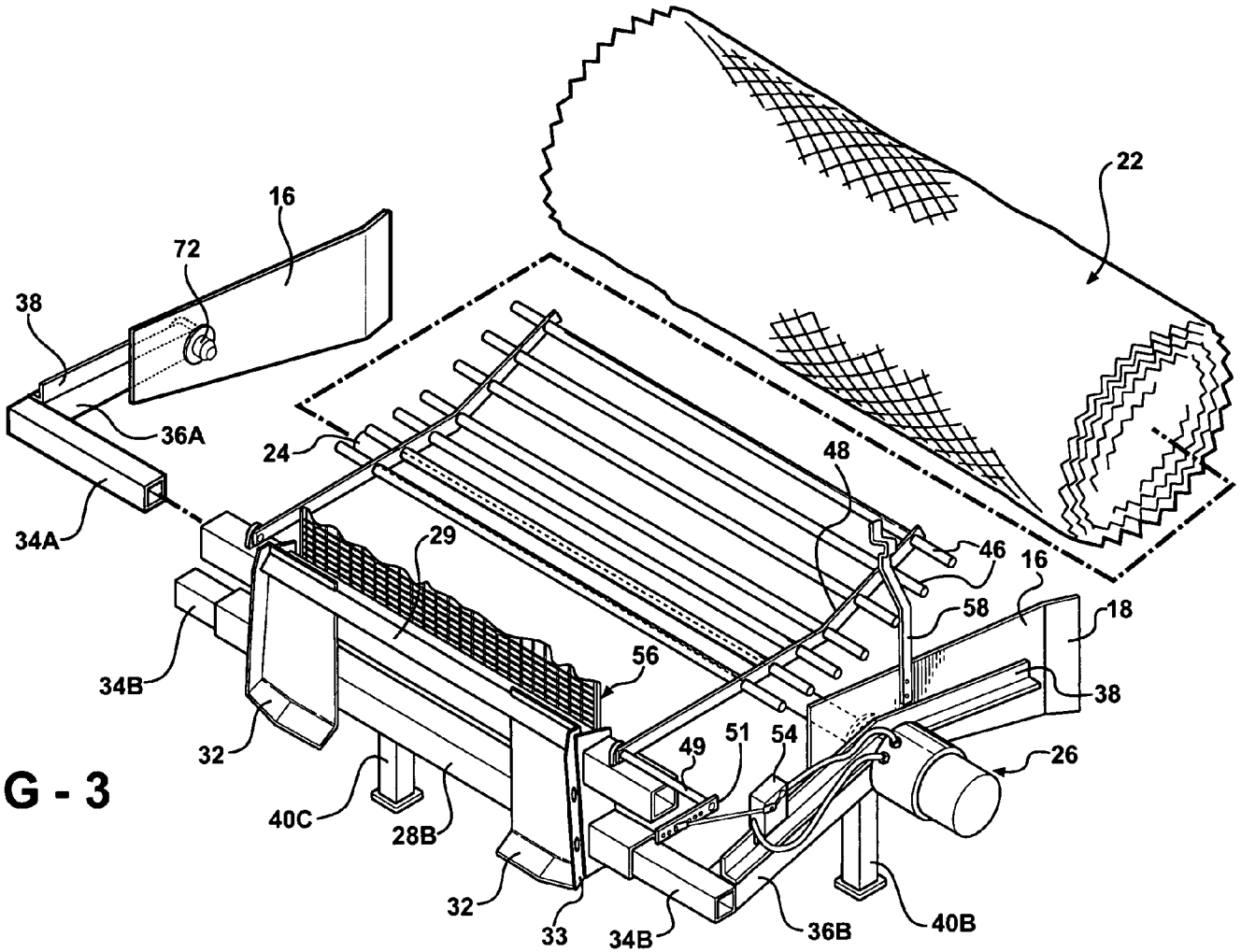
FIG. 3 is a partially exploded pictorial view of the rewinder shown in FIGS. 1 and 2, with one of the telescoping tubes shown broken away and a rewound roll of fencing fabric.

Referring to the drawings and particularly FIGS. 1–3, the fencing fabric rewinder 12 10 is shown mounted on a utility vehicle 10 such as a BOBCAT™, that has a pair of lift arms 14, detachably mounted to the rewinder 12 in a manner well known in the context of other equipment.

A pair of on edge vertically oriented a side plates 16 with outwardly flared entry portions 18 extending past a core tube 24 a substantial distance in the direction from which the rewound fencing is drawn guide movement of a length of fencing fabric 20 into the space 17 between the side plates 16. A rewound fabric roll 22 is formed by rewinding of the fencing fabric 20 onto the wind up core tube 24 (FIG. 2) by operation of a rotary hydraulic motor 26 drivingly coupled to the core tube 24 to rotate the same.

The side plates 16 are affixed to a framework including two vertically stacked sets of telescoping square tube sets 26A, 26B including respective larger outer square tubes 28A, 28B which are welded to plates 30 in turn welded to attachment pieces 32 designed to be secured to the utility vehicle lifting arms 14 by hooking to a downwardly inclined cross bar 29 and holes 31 in side flanges 33 of the pieces 32.

Inner square tubes 34A, 34B are telescoped into the outer tubes 28A, 28B, each having an end welded to the rear end of respective forwardly extending square tubes 36A, 36B, which in turn are welded to respective side plates 16. A stiffener angle 38 is affixed to the top of each square tube 36A.

Vertical pedestal rests 40A, 40B, 40C are affixed to the leading ends of tubes 36A, 36B to position the side plates 16 above the ground when the rewinder 12 is lowered to allow convenient attachment to the arms 14 of the vehicle 10.

A guard cage 44 comprised of a series of parallel cross tubes 46 is mounted on upwardly angled arms 48 pivoted to brackets 50 affixed to the top of the upper outer square tube 28B.

Figure 4:
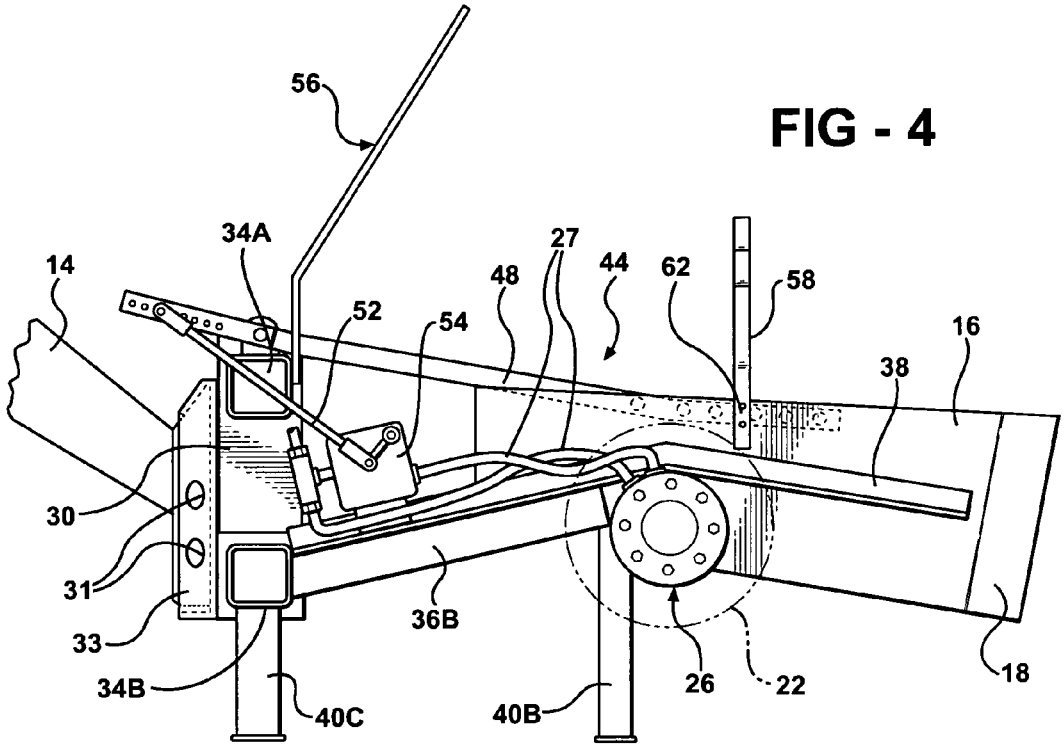
FIG. 4 is a side view of the rewinder shown in FIGS. 1–3 with the guide cage lowered to contact a partially rewound roll of fencing fabric depicted in phantom lines.
Figure 5:
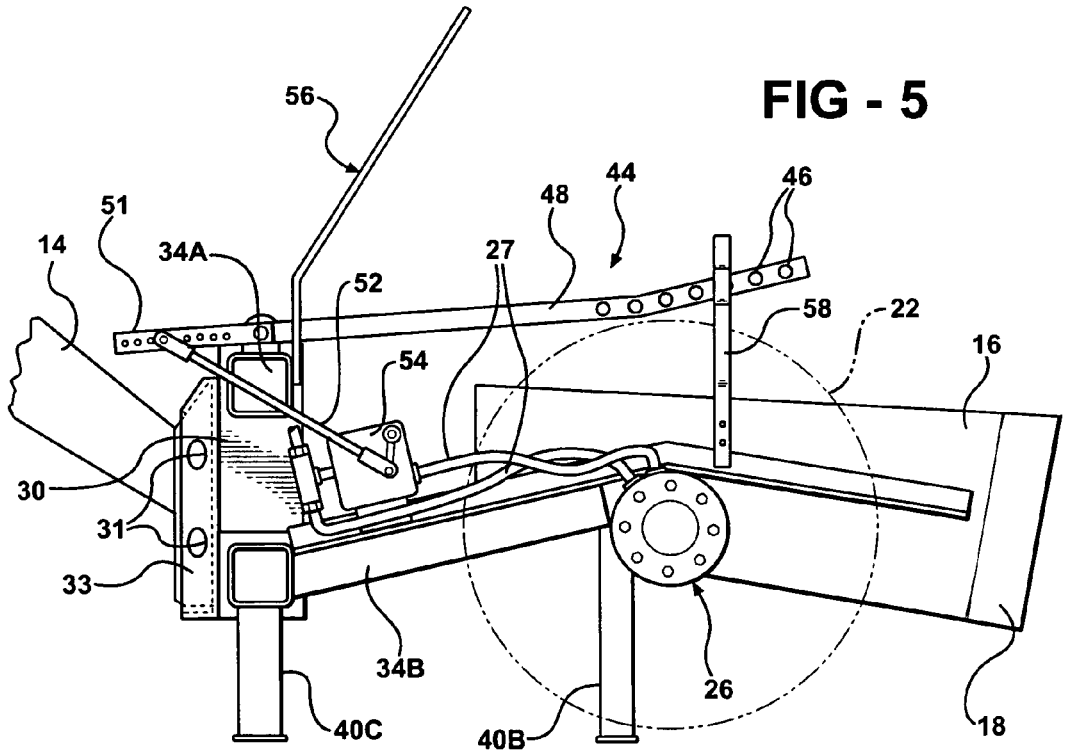
FIG. 5 is a side view of the rewinder as shown with the guide cage moved up in contact with a larger roll of fencing fabric depicted in phantom lines.

The cross tubes 46 are thereby positioned over the roll 22 with the arms 48 in contact with the roll 23 and the guard cage 44 is thus swung up as the roll 22 grows larger as the wound up fencing fabric 20 accumulates as shown in FIGS. 4 and 5.

One of the arms 48 is connected to a pivot rod 49, link 51 and control rod 52 extending to a control valve 54 controlling the flow of hydraulic fluid and thus the rotational speed of the hydraulic motor 26 via hydraulic lines 27 rotating the core 24.

This speed is adjusted thereby so as to reduce the rate of rotation as the roll 22 grows larger, keeping the linear speed of the fabric 20 lower, i.e., at a walking speed on the order of 3 mph as it is drawn onto the roll 22.

A vertical grating shield 56 is affixed to the upper square tube 28B to prevent debris from being thrown into the operator's cab, angled to allow easier access to the cab.

A prop arm 58 has a pocket 60 formed therein to capture an end of one of the tubes 46 to hold the guard cage 44 up for removing rolls 22 and core 24. A spring urges the prop arm 58 inward to be secured to the tube 46.

Figure 6:
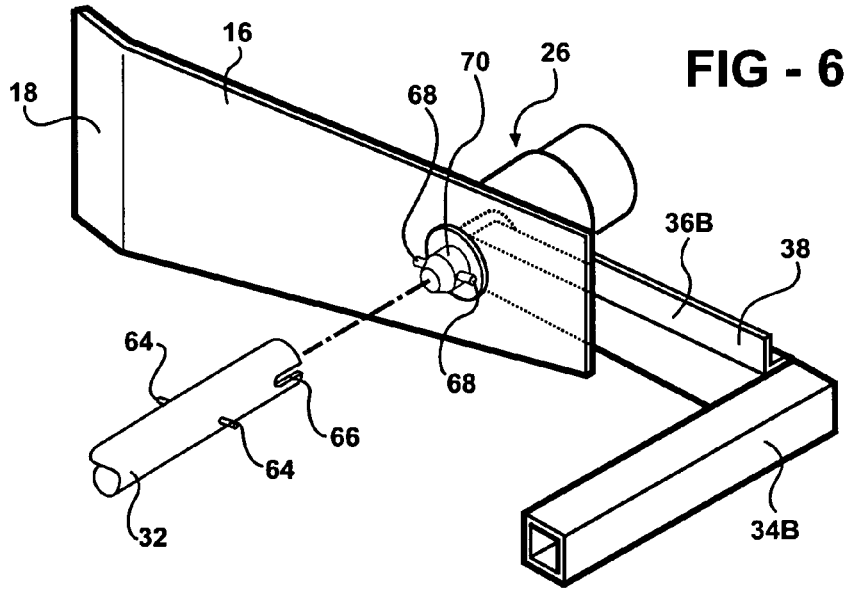
FIG. 6 is a partially exploded view of one end of a wind up core and core drive.

In use, after hook up of the fabric 20 to cross pins 64 on each end of the core tube 24 (FIG. 6), the utility vehicle 10 elevates the rewinder 12 well above the ground while the motor 26 is activated to wind up the fabric 20 onto the tube core 24. The core tube 24 has drive slots 66 on one end to be engaged by pins 68 on a drive hub 70 of the motor 26 (FIG. 6). The rewinder 12 is lowered to allow the roll 22 to rest on the ground, unweighting the core tube 24.

The roll 22 and core tube 24 are then removed by telescoping the inner square tube 34B out as seen in FIG. 3, slipping a plug 72 (FIG. 3) support out of engagement with the other end of the core tube 24. This allows the one end of the core tube 24 to be pulled out of engagement with a drive hub 70 of the motor 26 by turning of the vehicle 10, to remove the core tube 24 and roll 22 from the rewinder 10.

Figure 7:
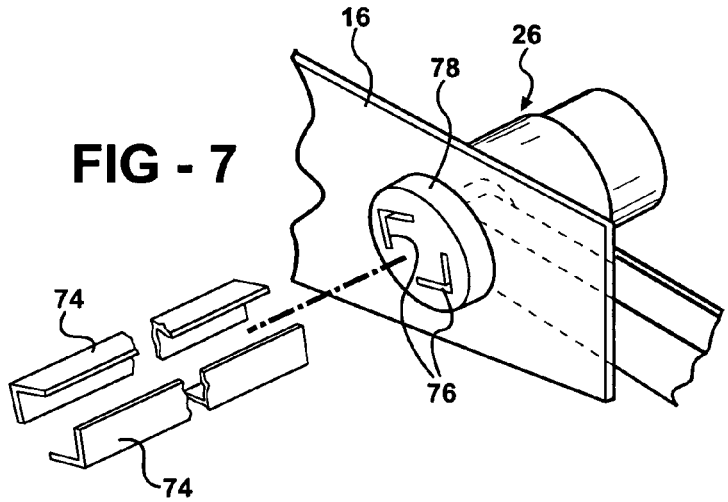
FIG. 7 is a partially exploded view of an alternative form of a wind up core shown partially broken away, and a drive hub for one end of the core mounted on one of the side plates which can be removed from a wound up roll.
Figure 8:
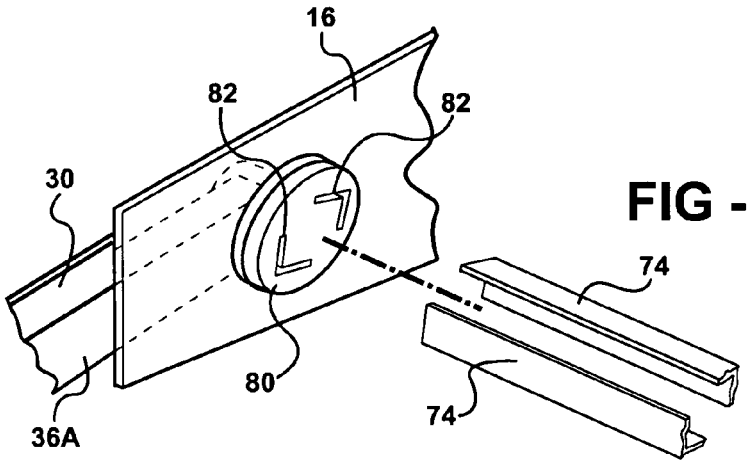
FIG. 8 is a partially exploded reverse pictorial view of the wind up core shown in FIG. 7 with pictorial view of a rotary support for the other end of the core and a fragmentary view of the other side plate.

FIG. 7 shows an alternative core structure using two spaced apart elongate angle bars 74, each end received in complementary slots 76 in a rotary drive element 78. Motor 26 drives element 78. A rotary support 80 (FIG. 8) is mounted to one side plate 16 formed with slots 82. Upon slide out of the single bars 74 after telescoping side plate 16 out, the angle bars 74 will drop together and allow their removal from the wound up roll (not shown).

Figure 9:
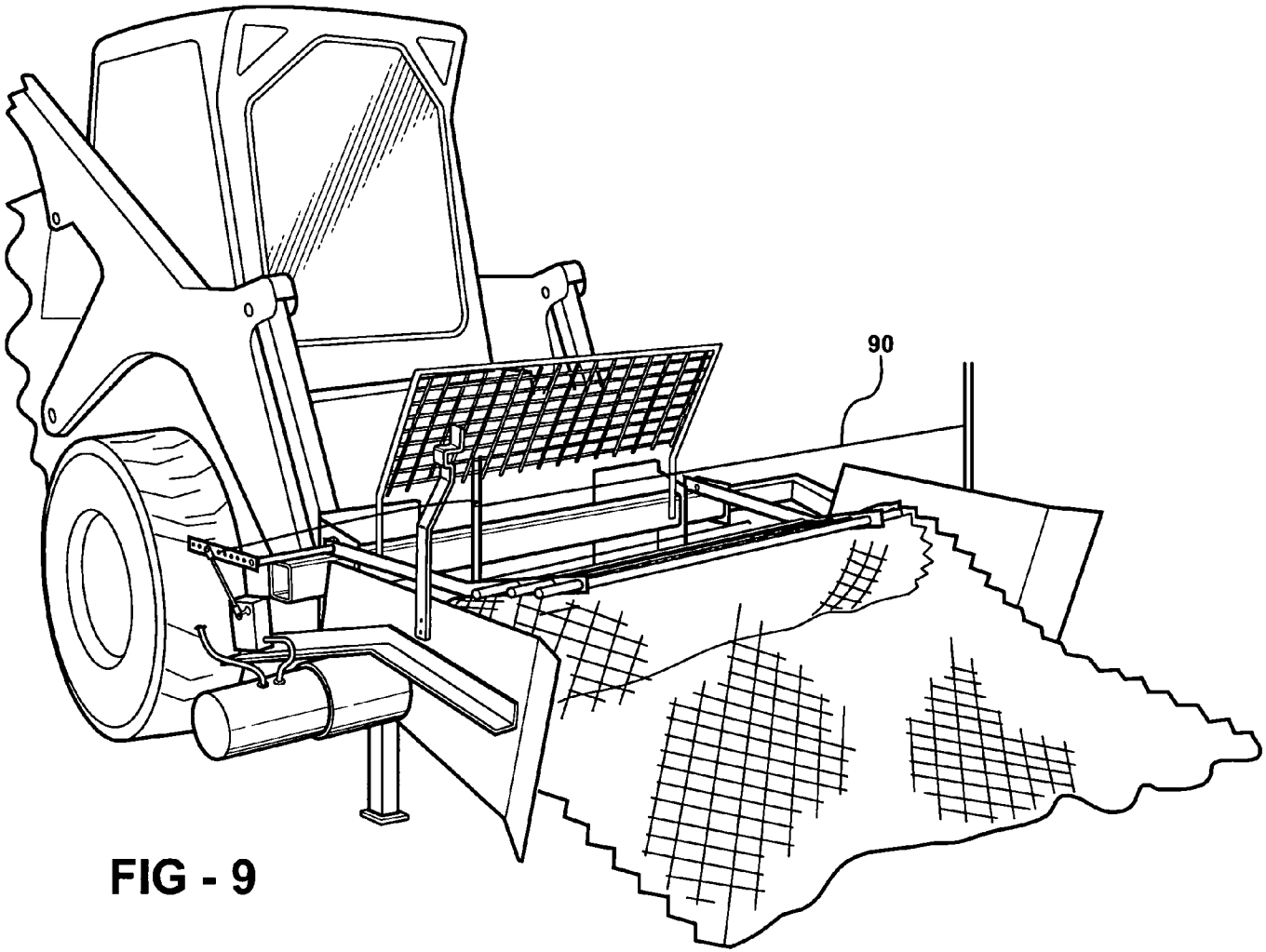
FIG. 9 is a pictorial view of a rewinder according to the invention installed on vehicle, with an emergency shut off cable mounted thereon.

An emergency shut down cable 90 (FIG. 9) can be strung between and above the side plates 16 connected to shut off the motor 26 if hit by a person or large object as an additional safety feature.

What is claimed is:

1. A fencing fabric rewinder for mounting on a utility vehicle, comprising:

a pair of spaced apart vertically on edge oriented side plates having an intervening space therebetween able to receive fencing fabric therein;

said side plates supported by a framework including respective elongated members able to be telescoped out in either lateral direction to change the spacing between said side plates;

a drive motor on one of said side plates engagable with a one end of a wind up core extending between said side plates; a support on the other of said side plates engagable with an opposite end of said core to support the same for rotation as said one end is rotated by said drive motor; and said side plates having entry portions thereof located a distance; forward of said core and angled outwardly from each other to guide said fencing fabric to be rewound onto said core whereby a length of fencing fabric hooked to said core can be wound up on said core by rotation thereof by said drive motor and guided onto said core by said side plate entry portions.

2. The apparatus according to claim 1 wherein a series of pedestals are attached to said framework to support said framework on the ground during attachment to said utility vehicle.

3. A fencing fabric rewinder for mounting on a utility vehicle comprising:

a pair of spaced apart side plates having an intervening space therebetween able to receive fencing fabric therein;

said side plates supported by a framework including respective elongated members able to be telescoped out in either lateral direction to change the spacing between said side plates;

a drive motor on one of said side plates engageable with a one end of a wind up core extending between said side plates; a support on the other of said side plates engageable with an opposite end of said core to support the same for rotation as said one end is rotated by said drive motor, whereby a length of fencing fabric hooked to said core can be wound up on said core by rotation thereof by said drive motor; and a guard extending between said side plates located above said core, said guard pivotally mounted to be able to swing down atop fencing fabric wound into a roll on said core.

4. The apparatus according to claim 3 further including a control for said drive motor for varying the rotary speed thereof, said control interconnected with said guard to decrease the motor rotation rate when said guard pivots up as said wound up fencing fabric forms a greater diameter roll to thereby maintain a moderate linear speed of said fencing fabric as it is wound onto said roll.

5. The apparatus according to claim 3 wherein said guard includes a series of parallel elongate members supported on respective arms connected thereto.

6. A fencing fabric winder for mounting on a utility vehicle comprising:

a pair of side plates having an intervening space therebetween able to receive fencing fabric therein;

said side plates supported by a framework including respective elongated members able to be telescoped out in either lateral direction to change the spacing between said side plates;

a drive motor on one of said side plates engagable with a one end of a wind up core tube extending between said side plates; a support on the other of said side plates enable with an opposite end of said core tube to support the same for rotation as said core tube is rotated by said drive motor, whereby a length of fencing fabric hooked to said core can be wound up on said core by rotation thereof by said drive motor;

said core tube having said opposite end received over a stub shaft projecting from said other side plate, comprising said support; and said drive motor driving a slotted tubular coupling receiving said one end of said core tube, said core tube having one or more pins on said one end each received in a respective axial slot in said coupling to establish driving engagement.

* * * * *